US006439172B1

(12) United States Patent
McGovern et al.

(10) Patent No.: US 6,439,172 B1
(45) Date of Patent: Aug. 27, 2002

(54) WATER-COOLED REMOTE FAN DRIVE

(75) Inventors: Kevin M. McGovern, Canton; Dale A. Stretch, Novi, both of MI (US); Gùenther F. Muehlbach, Markdorf (DE)

(73) Assignee: Borg Warner, Inc., Troy, MI (US)

( * ) Notice: Subject to any disclaimer, the term of this patent is extended or adjusted under 35 U.S.C. 154(b) by 0 days.

(21) Appl. No.: 09/768,902

(22) Filed: Jan. 24, 2001

(51) Int. Cl.[7] ..... F16D 35/02
(52) U.S. Cl. ..... 123/41.48
(58) Field of Search ..... 123/41.48, 41.11, 123/41.49; 192/58.63; 474/148, 149

(56) References Cited

U.S. PATENT DOCUMENTS

| | | | | |
|---|---|---|---|---|
| 3,272,188 A | | 9/1966 | Sabat | |
| 3,444,748 A | | 5/1969 | Sutaruk | |
| 3,845,666 A | | 11/1974 | Avramidis | |
| 5,871,412 A | * | 2/1999 | Moser | 474/76 |
| 6,021,747 A | | 2/2000 | Gee et al. | |

FOREIGN PATENT DOCUMENTS

| | | |
|---|---|---|
| DE | 29 31 305 A1 | 2/1981 |
| DE | 34 40 428 A1 | 5/1985 |
| DE | 43 35 342 A1 | 4/1995 |

* cited by examiner

*Primary Examiner*—Marguerite McMahon
*Assistant Examiner*—Hyder Ali
(74) *Attorney, Agent, or Firm*—Artz & Artz, P.C.; Greg Dziegielewski

(57) ABSTRACT

A water-cooled remote fan assembly 59, 100 having an extra pulley set mounted between a water drive mechanism 81, 122 and a cooling fan 68, 114 for creating a second overdrive mechanism used to increase the rotational speed of the fan 68, 114 relative to the engine input speed. This provides the pulley-driven engine cooling system with improved cooling capabilities at low engine speeds. By decreasing the radius of one of the pair of auxiliary pulleys 62, 102, 87, 104 mounted to a transfer drive mechanism 66, 116 relative to the radius of a crankshaft pulley 80, 130, the transfer drive mechanism 66, 116 can rotate at a faster rate than the crankshaft pulley 80, 130. One or both of the pair of auxiliary pulleys 102, 104 may be mounted on a shroud 106 of the radiator 108 to provide better fan orientation and higher efficiencies for fan performance.

29 Claims, 5 Drawing Sheets

PRIOR ART

10

WATER-COOLED REMOTE FAN DRIVE

TECHNICAL FIELD

The invention relates generally to cooling systems and more specifically to water-cooled remote fan drives.

BACKGROUND ART

Cooling -systems are used on vehicles today to provide cooling to an engine during operation. Fan drives are typically driven by the engine crankshaft at a fixed ratio to cool engine coolant as it flows through a radiator. Thus, as the engine speed is reduced, as is the trend in vehicles today to reduce emissions, the fan drive speed is correspondingly reduced. Similarly, as the engine speed increases, the fan drive speed correspondingly increases.

Many cooling systems, for example truck cooling systems, suffer from inefficient or insufficient cooling capabilities. For example, many cooling systems suffer from insufficient idle and peak air cooling, poor fan efficiencies, no or inadequate fan drive pulley ratios, and/or poor fan orientation relative to radiators.

It is thus highly desirable to create extra overdrive in a cooling system to improve the cooling capabilities of cooling systems to overcome some of the above described prior art deficiencies. The proposed system should be able to be used with currently available engine and radiator locations, should allow a minimum radial displacement between an engine and a radiator, should allow for axial motion of the engine, should maximize fan size within a predetermined packaging volume, and have a predetermined torque capability for driving the fan.

SUMMARY OF THE INVENTION

The above and other objects of the invention are met by the present invention that is an improvement over known fan drive systems.

The present invention incorporates an additional pulley that is either mounted on the shroud of the radiator or mounted to the front of the water pump and crank pulleys. This additional pulley is sized smaller than the crank pulley to create extra overdrive. This allows the fan to rotate at a faster speed, which improves the cooling efficiency of the radiator. Further, these remote fan drives are water-cooled by making them integral to the water pump or by coupling them to the water pump to improve heat dissipation and reduce weight and packaging size. In an alternative arrangement, more than one additional pulley may be added.

Further, in the case of the fan mounted on the shroud, this system provides a shroud mounted fan with high efficiencies due to tight blade tip clearance, ideal fan orientation, and large overdrive ratio options because of water-cooled heat dissipation. Also, there is the potential for using dual fans in these systems, which could also improve fan efficiency and fan orientation.

Other features, benefits and advantages of the present invention will become apparent from the following description of the invention, when viewed in accordance with the attached drawings and appended claims.

Best Mode(s) For Carrying Out The Invention

Figure 1:
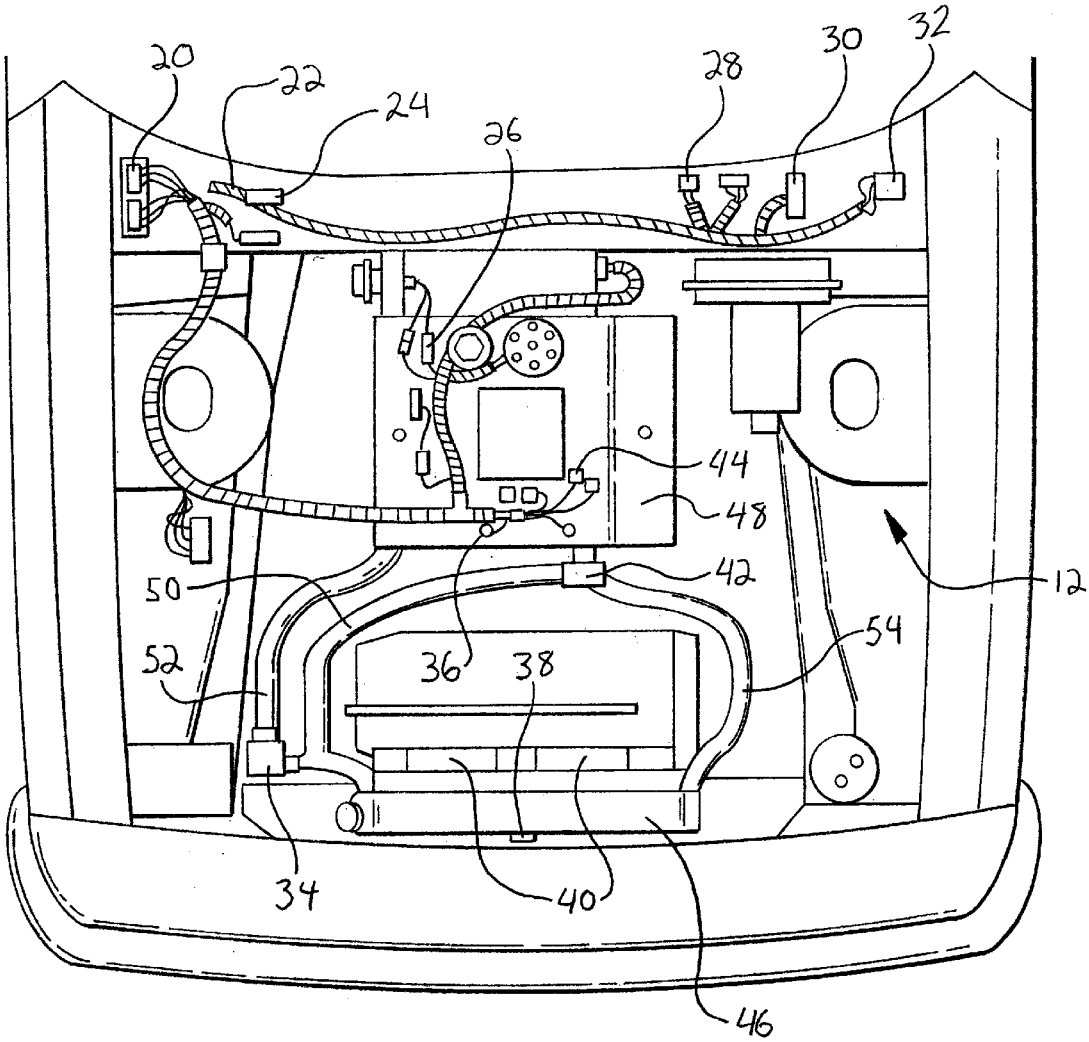
FIG. 1 is a schematic representation of a cooling system according to the prior art.

Referring now to FIG. 1, a vehicle 10 is illustrated having a cooling system 12 according to one embodiment in the prior art. The cooling system 12 depicted has a powertrain control module 20, a computer control harness 22, a check engine lamp driver 24, a cylinder head temperature sensor 26, a check engine light 28, a vehicle speed sensor 30, a fuse panel 32, an integrated water pump/fan drive, commonly called a water cooled fan drive 34, an engine coolant sensor 36, an ambient temperature sensor 38, one or more cooling fans 40, a flow control valve 42, a throttle position sensor 44, and a radiator 46.

In operation, when an internal combustion engine 48 is started, coolant (not shown) enters the water-cooled fan drive 34 through a branch duct 50 from the radiator 46. Coolant is then pumped out of the water-cooled fan drive 34 through a return duct 52 and into the cooling passages (not shown) of the engine 48. The coolant flows through the engine to the flow control valve 42. Coolant will then flow back to the radiator 46 through the supply duct 54 or be bypassed through the branch duct 50 depending upon the engine coolant temperature as determined by the engine coolant temperature sensor 36. When the engine 48 is cool, the flow control valve 42 directs the coolant through the branch duct 50. If the engine 48 is warm, the flow control valve 42 directs the coolant through the supply duct 54 to the radiator 46, where the coolant is cooled. One or more cooling fans 40 coupled to the water-cooled fan drive 34 blow cool air on the radiator to cool the engine coolant.

Cooling systems such as in FIG. 1 suffer from insufficient idle and peak air-cooling, poor fan efficiencies, no or inadequate fan drive pulley ratios, and/or poor fan orientation relative to radiators. This is especially true in truck systems.

Figure 2:
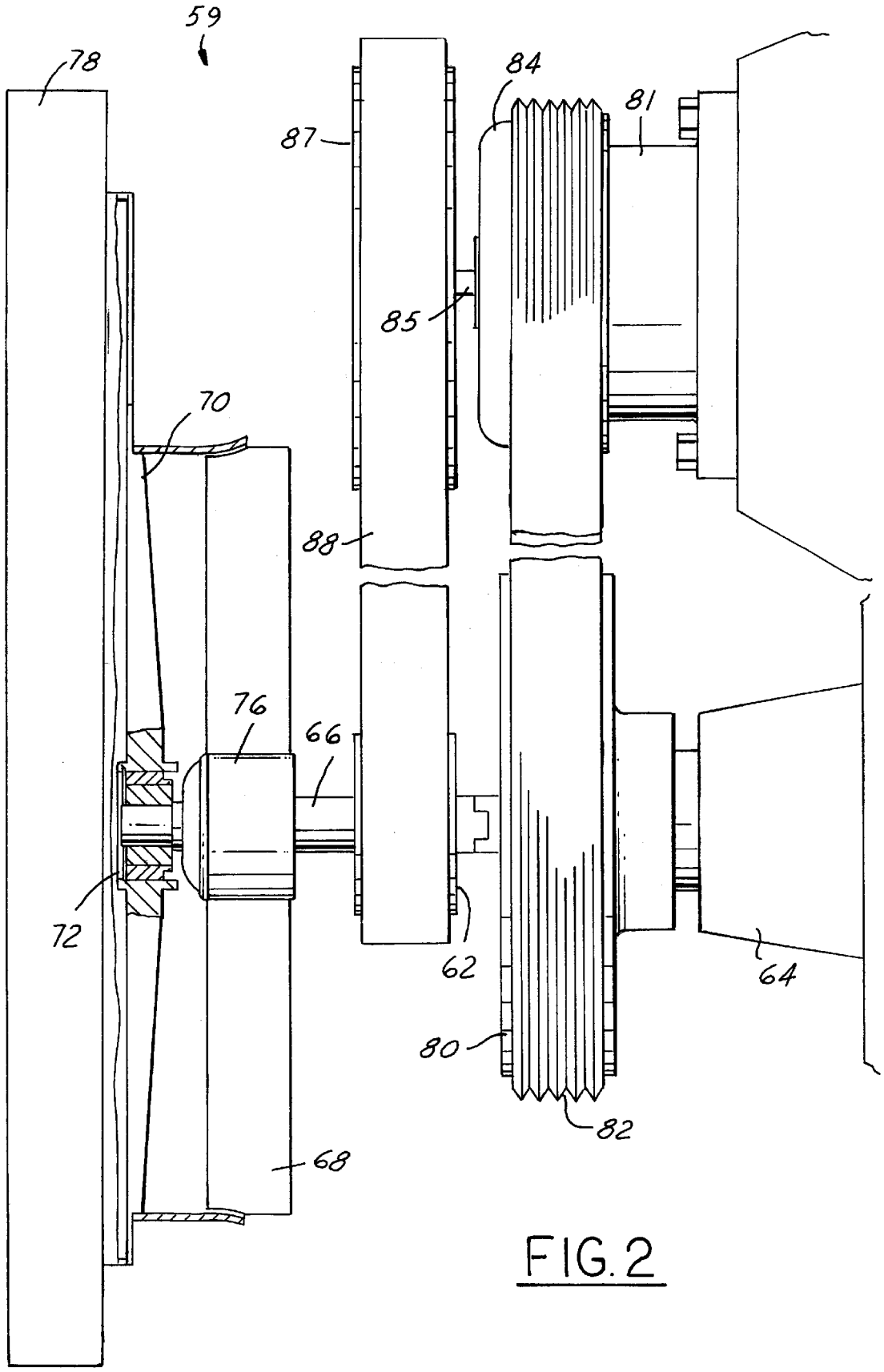
FIG. 2 is a cooling system having an auxiliary pulley set according to one embodiment of the present invention.
Figure 2A:
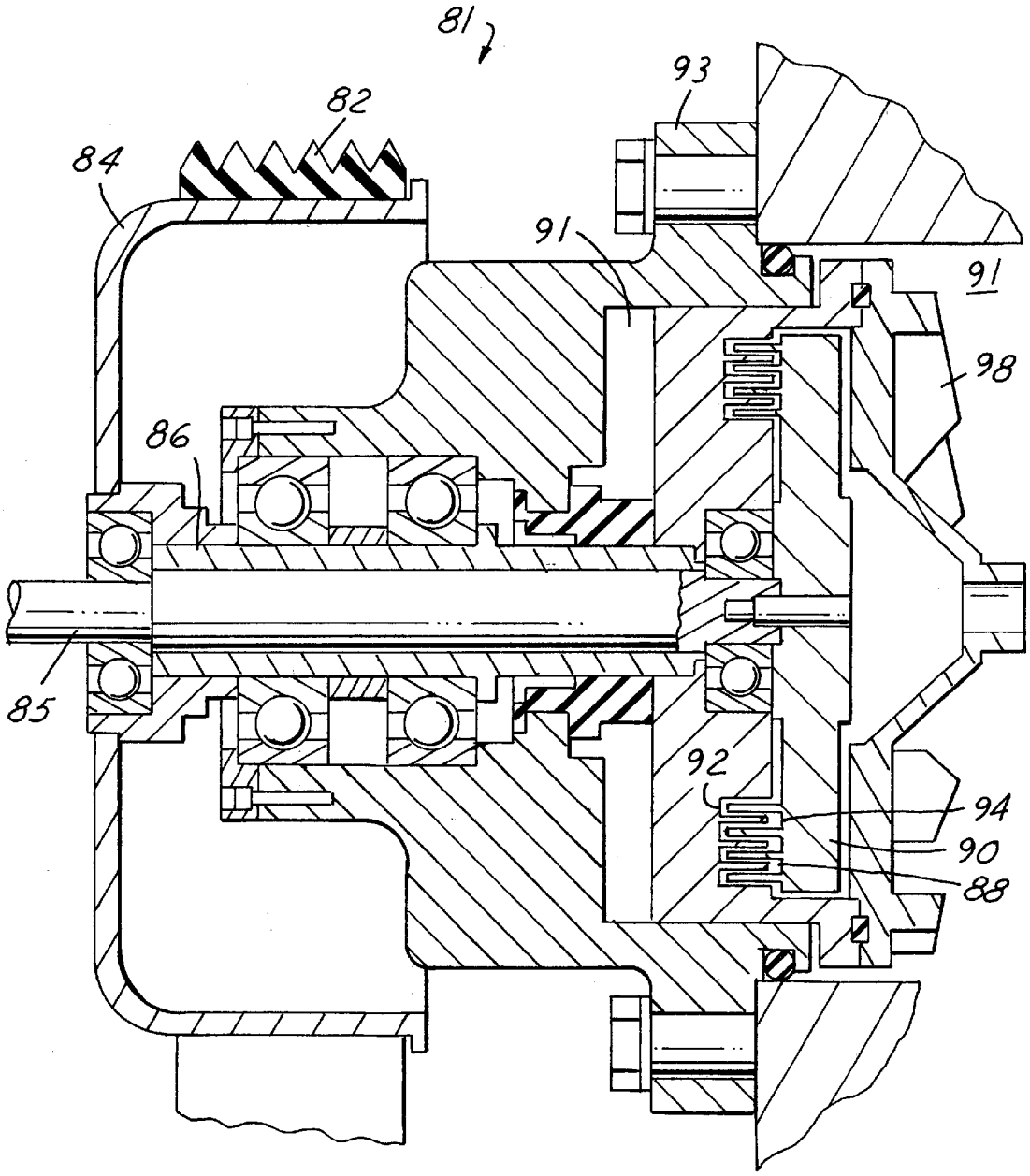
FIG. 2A is a section view of the water-cooled drive mechanism of FIG. 2.

To remedy some of these problems, in one preferred embodiment, as shown in FIGS. 2 and 2A, a cooling system 59 is depicted in which an additional auxiliary pulley 62 is mounted in front of and concentrically to a crankshaft 64. This auxiliary pulley 62 is bearing mounted to the crankshaft 64 and a transfer drive mechanism 66 which transfers torque to a radiator mounted fan 68. A fan support 70 is placed behind the fan 68 with a bearings 72 to fix the fan 68 to a dished hub 76 of the radiator 78. It is believed that the fan 68 will have better airflow to the radiator 78 when the fan support 70 is between the radiator 78 and the fan 68. In this embodiment, the transfer drive mechanism 66 is in the form of a flexible link such as a u-joint.

When an internal combustion engine (not shown) is running, the crankshaft 64 rotates at a rate equal to the engine speed. A crankshaft pulley 80 is mounted concentrically to the crankshaft 64 behind the auxiliary pulley 62 rotates in response to the crankshaft 64, which in turn causes a belt 82 coupled to the crankshaft pulley 80 to rotate. This belt 82 is coupled with a fan drive pulley 84 of the water-cooled drive mechanism 81. As best seen in FIG. 2A, the water-cooled drive mechanism 81 essentially consists of the fan drive pulley 84, a water pump drive shaft 86 coupled to the fan drive pulley 84, a clutch 90, and an impeller 87 coupled to the clutch 90. The rotation of the fan drive pulley 84 drives a water pump shaft 86 coupled to the pulley 84 to drive the impeller 87 to provide flow of engine coolant from the radiator 78 to the engine block (not shown) through the water-cooled drive mechanism 81 within the cooling system 59.

As the fan drive pulley 84 rotates, viscous fluid, typically a silicone-based fluid, sealed within a working chamber 88 between the pulley 84 and a clutch 90, is sheared, typically by grooves 92, 94 contained on the pulley 84 and clutch 90. This shearing causes the clutch 90 to rotate, producing torque proportional to the amount of slip (generally torque increases as a square of the rpm of the input member) to drive a fan drive shaft 85 that is coupled to the clutch 90. At low speeds, little torque is produced. At higher speeds, lots of torque is produced. In addition, heat that is generated by the shearing action of the viscous fluid in proportion to the amount of torque generated is dissipated by the engine coolant contained within the impeller chamber 91 that is defined between the clutch 90 and the outer housing 93 of the water-cooled drive mechanism 81.

Referring back to FIG. 2, a second fan drive pulley 87 rotates in response to the fan drive shaft 85 rotation, which causes a belt 88 coupled to this second fan drive pulley 87 to turn. This in turn causes the auxiliary pulley 62, which is coupled to the belt 88, to rotate, which in turn causes the transfer drive mechanism 66 to transfer torque to the fan 68, thereby causing the fan 68 to spin and cool the radiator 78.

The rotational speed of the transfer drive mechanism 66, and correspondingly the rotational speed of the fan 68, may be adjusted by varying the size (diameter) of the crankshaft pulley 80 relative to the auxiliary pulley 62. In a preferred embodiment, this pulley size ratio is approximately 1.5/1. As the auxiliary pulley 62 is made smaller, the time necessary for a complete revolution of the auxiliary pulley 62 decreases, resulting in the speed of rotation of the transfer drive mechanism 66 increasing. This in turn increases the rotational speed of the fan 68, which results in more airflow for cooling of engine coolant within the radiator 78.

Similarly, the rotational speed of the transfer drive mechanism 66, and correspondingly the rotational speed of the fan 68, may be adjusted by varying the size of the crankshaft pulley 80 relative to the fan drive pulley 84, by adjusting the size of the fan drive pulley 84 to the auxiliary pulley 62, or by adjusting the size of the crankshaft pulley 80 relative to the second fan pulley 87.

To improve the fan effective surface area available for cooling the engine coolant, a second smaller fan (not shown) could be mounted within the large fan 68. Alternatively, the smaller fan could be used as a "hub" and actually be built within the large fan 68.

Figure 3:
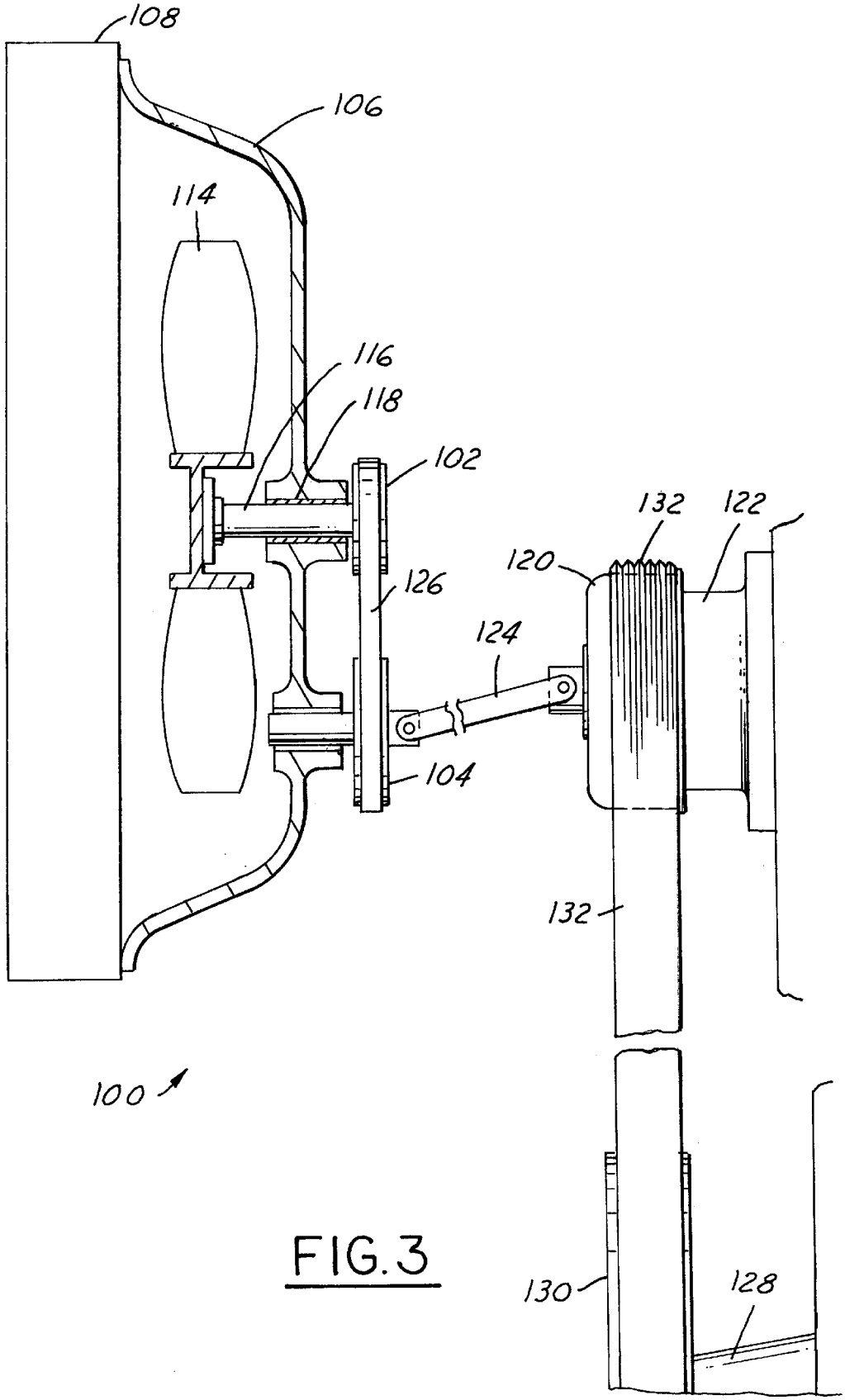
FIG. 3 is a cooling system having an auxiliary pulley set mounted to the shroud of a radiator according to another embodiment of the present invention.
Figure 3A:
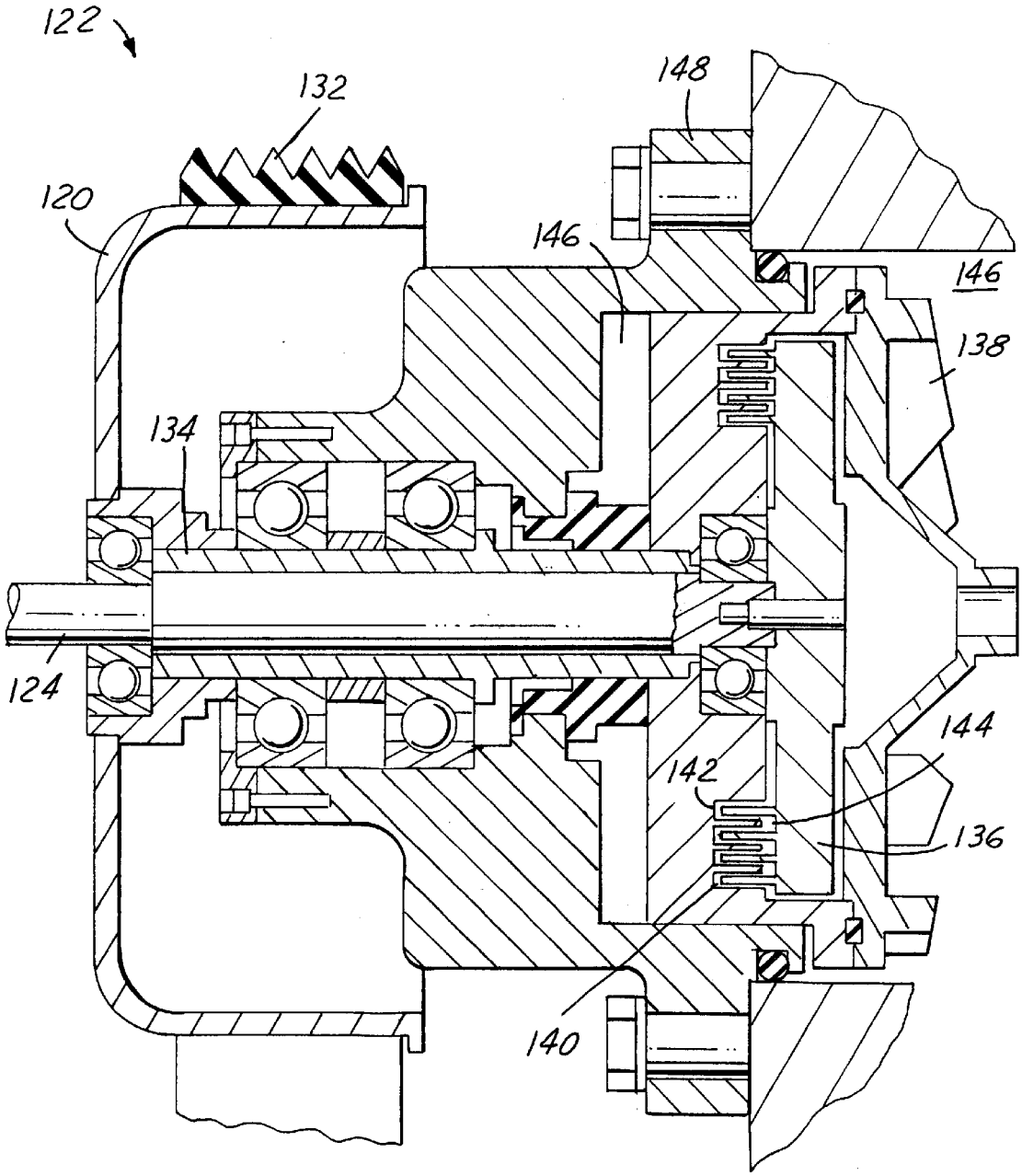
FIG. 3A is a section view of the water-cooled drive mechanism of FIG. 3.

In another preferred embodiment of the water cooled remote fan drive 100, as shown in FIGS. 3 and 3A, the pair of auxiliary pulleys 102, 104 are mounted to the shroud 106 of a radiator 108 using bearings (not shown) as compared to being bearing mounted on the crankshaft 64 and coupled to the water-cooled drive mechanism 81 as in FIG. 2.

Auxiliary pulley 102 is coupled to the fan 114 via a transfer drive mechanism 116 which transfers torque to a shroud mounted fan 114. Transfer drive mechanism 116 is also bearing mounted to the shroud 106.

Second fan drive pulley 104 is coupled with a fan drive pulley 120 of the water-cooled mechanism 122 by a second transfer drive mechanism 124. In this embodiment, the second transfer drive mechanism 124 is in the form of a flexible link such as a u-joint.

When an internal combustion engine (not shown) is running, the crankshaft 128 rotates at a rate equal to the engine speed. A crankshaft pulley 130 is mounted concentrically to the crankshaft 128 and rotates in response to the crankshaft 128, which in turn causes a belt 132 coupled to the crankshaft pulley 130 to rotate. This belt 132 is coupled with the fan drive pulley 120 of the water-cooled drive mechanism 122. As best seen in FIG. 3A, the water-cooled drive mechanism 122 essentially consists o f the fan drive pulley 120, a water pump drive shaft 134 coupled to the fan drive pulley 120, a clutch 136, and an impeller 138 coupled to the clutch 136. The rotation of the fan drive pulley 120 drives a water pump shaft 134 coupled to the fan drive pulley 120 to drive the impeller 138 to provide flow of engine coolant from the radiator 108 to the engine block (not shown) through the water-cooled drive mechanism 122 within the cooling system. Of course, in alternative embodiments as are known in the art, the rotation of the clutch 136 itself could drive the impellers 138 to provide flow of engine coolant through the cooling system.

As the fan drive pulley 120 rotates, viscous fluid, typically a silicone-based fluid, sealed within a working chamber 140 between the fan drive pulley 120 and a clutch 136 is sheared, typically by grooves 142, 144 contained on the fan drive pulley 120 and clutch 136. This shearing causes the clutch 136 to rotate, producing torque proportional to the amount of slip (generally torque increases as a square of the rpm of the input member) to drive a transfer drive mechanism 124 that is coupled to the clutch 136. At low speeds, little torque is produced. At higher speeds, lots of torque is produced. In addition, heat that is generated by the shearing action of the viscous fluid in proportion to the amount of torque generated is dissipated by the engine coolant contained within the impeller chamber 146 that is defined between the clutch 136 and the outer housing 148 of the water-cooled drive mechanism 122.

Referring back to FIG. 3, second fan drive pulley 104 coupled to the second transfer drive mechanism 124 rotates in response to the second transfer drive mechanism 124 rotation, which causes a belt 126 coupled to this second fan drive pulley 104 to turn. This in turn causes the auxiliary pulley 102, which is also coupled to the belt 126, to rotate, which in turn causes the transfer drive mechanism 116 to transfer torque to the fan 114, thereby causing the fan 114 to spin and cool the radiator 108.

The rotational speed of the transfer drive mechanism 116, and correspondingly the rotational speed of the fan 114, may be adjusted by varying the size of the crankshaft pulley 130 relative to the auxiliary pulley 102. In a preferred embodiment, this pulley size ratio is approximately 1.5/1. As the auxiliary pulley 102 is made smaller, the time necessary for a complete revolution of the auxiliary pulley 102 decreases, resulting in the speed of rotation of the transfer drive mechanism 116 increasing. This in turn increases the rotational speed of the fan 114, which results in more airflow for cooling of engine coolant within the radiator 108.

Similarly, the rotational speed of the transfer drive mechanism 116, and correspondingly the rotational speed of the fan 114, may be adjusted by varying the size of the crankshaft pulley 130 relative to the fan drive pulley 120, by varying the size of the second fan drive pulley 104 relative to the auxiliary pulley 102, or by varying the size of the crankshaft pulley 130 relative to the second fan drive pulley 104.

To improve the fan effective surface area available for cooling the engine coolant, a second smaller fan (not shown) could be mounted within the large fan 114. Alternatively, the smaller fan could be used as a "hub" and actually be built within the large fan 114.

The above invention offers many improvements over currently available fan cooling systems. First, the addition of a second pulley set creates a second overdrive mechanism, wherein this second overdrive mechanism increases the air cooling capabilities of the cooling system at lower engine speed or idle conditions by increasing the rotational speed of the fan relative to the input speed from the engine. Second, by integrating the fan drive into the water pump, heat dissipation of the fan drive mechanism is improved while decreasing packaging space and reducing weight. By water cooling the fan drive, larger overdrive ratios (i.e. pulley ratios) are possible to increase cooling efficiency without overheating the fan drive at high engine speeds. Third, by mounting the fan on the shroud of the radiator, the efficiency of the fan is improved due to tight fan blade tip to shroud clearance and better fan orientation to the radiator. Fourth, the efficiency of cooling can be improved further by mounting a second smaller fan to the transfer drive mechanism to create larger effective fan area.

Of course, in alternative embodiments as are known in the art, one of the possible many variations of water-cooled viscous couplings could add a second set of additional pulleys to create a second drive mechanism and still fall within the spirit of the invention. Also, for example, a viscous coupling having a water jacket could be coupled to a water pump to dissipate the heat buildup created by slippage between the fan drive pulley and the clutch, instead of combining the viscous coupling with the water pump into a water-cooled drive mechanism as in FIGS. 2 and 3.

While the invention has been described in terms of preferred embodiments, it will be understood, of course, that the invention is not limited thereto since modifications may be made by those skilled in the art, particularly in light of the foregoing teachings.

What is claimed is:

1. A water-cooled remote fan drive assembly 59, 100 comprising:

an engine crankshaft 64, 128 coupled to an engine, said engine having an engine block;

a radiator 78, 108 in fluid communication with said engine block;

a fan 68, 114 mounted on said radiator 78, 108;

a transfer drive mechanism 66, 116 coupled to said fan 68, 114;

a water-cooled drive mechanism 81, 122 having a fan drive pulley 84, 120, a clutch 90, 136, a working chamber 88, 140 defined between said fan drive pulley 84, 120 and said clutch 90, 136, a quantity of viscous fluid contained within said working chamber 88, 140, and an impeller 98, 138 contained within an impeller chamber 91, 146 coupled to said clutch 90, 136, said impeller chamber 91, 140 in fluid communication with said radiator 78, 108 and said engine block;

a second fan drive pulley 87, 104 coupled to said clutch 90, 136;

a crankshaft pulley 80, 130 mounted to said engine crankshaft 64, 128, said crankshaft pulley 80, 130 having a first radius;

a belt 82, 132 rotatably coupled to said crankshaft pulley 80, 130 and said fan drive pulley 84, 120;

an auxiliary pulley 62, 102 coupled to said transfer drive mechanism 66, 116 having a second radius, wherein said first radius and said second radius are sized to create a second overdrive mechanism to provide a desired rotational speed of said fan 68, 114 relative to engine speed; and a second belt 88, 126 rotatably coupled to said auxiliary pulley 62, 102 and said second fan drive pulley 87, 104.

2. The water-cooled remote fan drive assembly 59, 100 of claim 1, wherein said desired rotational speed of said fan 68, 114 is a function of a desired cooling rate for engine coolant within said radiator 78, 108 at low engine speeds or engine idle speeds.

3. The water-cooled remote fan drive assembly 59 of claim 1, wherein said auxiliary pulley 62 is bearing supported on said crankshaft 64 and wherein said second drive pulley 87 is coupled to said clutch 90 via a fan drive shaft 85.

4. The water-cooled remote fan drive assembly 100 of claim 1, wherein said second fan pulley 104 is bearing 118 mounted to a shroud 106 of said radiator 108 and coupled to said clutch 136 via a second transfer drive mechanism 124 and wherein said auxiliary pulley 102 is bearing mounted on said shroud 106.

5. The water-cooled remote fan drive assembly 59 of claim 3, wherein said first radius is approximately twice said second radius.

6. The water-cooled remote fan drive assembly 100 of claim 4, wherein said first radius is approximately twice said second radius.

7. A method for improving cooling capabilities at low engine speeds or engine idle conditions in a pulley-driven cooling system 59, 100, wherein the pulley-driven cooling system has a radiator 78, 108, a fan 68, 114 for cooling the radiator 78, 108, a water-cooled drive mechanism 81, 122 for rotating the fan 68, 114, and a crankshaft pulley 80, 130 coupled to a crankshaft 64, 128 of an engine for rotating the fan drive at a speed proportional to engine speed, the method comprising the step of:

coupling a second overdrive mechanism between the water-cooled drive mechanism 81, 122 and the fan 68, 114 to increase the rotational speed of a fan 68, 114 relative to the speed of the engine.

8. The method of claim 7, wherein the step of coupling a second overdrive mechanism to the pulley-driven cooling system comprises the step of coupling a second pulley set between the water-cooled drive mechanism 81, 122 and the fan 68, 114, said second pulley set comprising a second fan drive pulley 87, 104 and an auxiliary pulley 62,102, wherein a radius of said auxiliary pulley 62, 102 is sized smaller than the crankshaft pulley 80, 130 radius to create extra overdrive to drive the fan 68, 114 at an increased rotational speed relative to the speed on the engine.

9. The method of claim 8, wherein said radius of said auxiliary pulley 62, 102 is approximately one-half the radius of the crankshaft pulley 80, 130.

10. The method of claim 8, wherein said auxiliary pulley 62 is bearing mounted on the crankshaft 64 and said second fan drive pulley 87 is coupled to a fan drive shaft 85, said fan drive shaft 85 being coupled with a clutch 90 of the water-cooled drive mechanism 81.

11. The method of claim 8, wherein said auxiliary pulley 102 and said second fan drive pulley 104 are bearing mounted on a shroud 106 of said radiator 108, wherein said second fan drive pulley 104 is coupled with a clutch 136 of the water-cooled mechanism 122 by a second transfer drive mechanism 124.

12. The method of claim 7 further comprising the step of mounting a smaller fan within the fan 68, 114, wherein said smaller fan improves the effective surface area available for cooling said radiator 78, 108.

13. A remote fan drive assembly 59, 100 comprising:

an engine crankshaft 64, 128 coupled to an engine, said engine having an engine block;

a radiator 78, 108 in fluid communication with said engine block;

a fan 68, 114 mounted on said radiator 78, 108;

a transfer drive mechanism 66, 116 coupled to said fan 68, 114;

a water-cooled drive mechanism 81, 122 having a fan drive pulley 84, 120, said water-cooled drive mechanism 81, 122 in fluid communication between said radiator 78, 108 and said engine block;

a second fan drive pulley 87, 104 coupled to said water-cooled drive mechanism 81, 122;

a crankshaft pulley 80, 130 mounted to said engine crankshaft 64, 128, said crankshaft pulley 80, 130 having a first radius;

a belt 82, 132 rotatably coupled to said crankshaft pulley 80, 130 and said fan drive pulley 84, 120;

an auxiliary pulley 62, 102 coupled to said transfer drive mechanism 66, 116 having a second radius, wherein said first radius and said second radius are sized to create a second overdrive mechanism to provide a desired rotational speed of said fan 68, 114 relative to engine speed; and a second belt 88, 126 rotatably coupled to said auxiliary pulley 62, 102 and said second fan drive pulley 87, 104.

14. The remote fan drive assembly 59 of claim 13, wherein said second fan drive pulley 87 is integral with said water-cooled drive mechanism 81.

15. The remote fan drive assembly 100 of claim 13, wherein said second fan drive pulley 104 is coupled to said water-cooled drive mechanism 122 using a second transfer drive mechanism 124.

16. The remote fan drive assembly of claim 13, wherein said water-cooled drive mechanism 81, 122 comprises a water jacket-cooled viscous coupling coupled to a water pump, said water pump in fluid communication with said radiator 78, 108 and said engine block.

17. The remote fan drive assembly of claim 13, wherein said water-cooled drive mechanism 81, 122 comprises a fan drive pulley 84, 120, a clutch 90, 136, a working chamber 88, 140 defined between said fan drive pulley 84, 120 and said clutch 90, 136, a quantity of viscous fluid contained within said working chamber 88, 140, and an impeller 98, 138 contain ed within an impeller chamber 91, 146 coupled to said clutch 90, 136, said impeller chamber 91, 146 in fluid communication with said radiator 78, 108 and said engine block.

18. The water-cooled remote fan drive assembly 59 of claim 14, wherein said auxiliary pulley 62 is bearing supported on said crankshaft 64 and wherein said second drive pulley 87 is coupled to said clutch 90 via a fan drive shaft 85.

19. The water-cooled remote fan drive assembly 100 of claim 15, wherein said second fan pulley 104 is bearing mounted to a shroud 106 of said radiator 108 and coupled to said clutch 136 via a second transfer drive mechanism 124 and wherein said auxiliary pulley 102 is bearing mounted on said shroud 106.

20. The water-cooled remote fan drive assembly 59, 100 of claim 13, wherein said first radius is approximately twice said second radius.

21. A water-cooled remote fan drive assembly 100 comprising:

an engine crankshaft 128 coupled to an engine, said engine having an engine block;

a radiator 108 in fluid communication with said engine block;

a fan 114 mounted on said radiator 108;

a transfer drive mechanism 116 coupled to said fan 114;

a water-cooled drive mechanism 122 having a fan drive pulley 120, a clutch 136, a working chamber 140 defined between said fan drive pulley 120 and said clutch 136, a quantity of viscous fluid contained within said working chamber 140, and an impeller 138 contained within an impeller chamber 146 coupled to said clutch 136, said impeller chamber 140 in fluid communication with said radiator 108 and said engine block;

a second fan drive pulley 104 coupled to said clutch 136;

a crankshaft pulley 130 mounted to said engine crankshaft 128, said crankshaft pulley 130 having a first radius;

a belt 132 rotatably coupled to said crankshaft pulley 130 and said fan drive pulley 120;

an auxiliary pulley 102 coupled to said transfer drive mechanism 116 having a second radius, wherein said first radius and said second radius are sized to create a second overdrive mechanism to provide a desired rotational speed of said fan 114 relative to engine speed; end a second belt 126 rotatably coupled to said auxiliary pulley 102 and said second fan drive pulley 104;

wherein said second fan pulley 104 is bearing 118 mounted to a shroud 106 of said radiator 108 and coupled to said clutch 136 via a second transfer drive mechanism 124 and wherein said auxiliary pulley 102 is bearing mounted on said shroud 106.

22. The water-cooled remote fan drive assembly 100 of claim 21, wherein said first radius is approximately twice said second radius.

23. A method for improving cooling capabilities at low engine speeds or engine idle conditions in a pulley-driven cooling system 81, wherein the pulley-driven cooling system having a radiator 108, a fan 114 for cooling the radiator 108, a water-cooled drive mechanism 122 for rotating the fan 114, and a crankshaft pulley 130 coupled to a crankshaft 128 of an engine for rotating the fan drive at a speed proportional to engine speed, the method comprising the step of:

coupling a second pulley set between the water-cooled drive mechanism 122 and the fan 114, said second pulley set comprising a second fan drive pulley 104 and an auxiliary pulley 102, wherein a radius of said auxiliary pulley 102 is sized smaller than the crankshaft pulley 130 radius to create extra overdrive to drive the fan 114 at an increased rotational speed relative to the speed on the engine;

wherein said auxiliary pulley 102 and said second fan drive pulley 104 are bearing mounted on a shroud 106 of said radiator 108, wherein said second fan drive pulley 104 is coupled with a clutch 136 of the water-cooled drive mechanism 122 by a second transfer drive mechanism 124.

24. The method of claim 23, wherein said radius of said auxiliary pulley 102 is approximately one-half the radius of the crankshaft pulley 130.

25. The method of claim 24 further comprising mounting a smaller fan within the fan 114 wherein said smaller fan improves the effective surface area available for cooling said radiator 108.

26. A remote fan drive assembly 100 comprising:

an engine crankshaft 128 coupled to an engine, said engine having an engine block;

a radiator 108 in fluid communication with said engine block;

a fan 114 mounted on said radiator 108;

a transfer drive mechanism 116 coupled to said fan 114;

a water-cooled drive mechanism 122 having a fan drive pulley 120, said water-cooled drive mechanism 122 in fluid communication between said radiator 108 and said engine block;

a second fan drive pulley 104 coupled to said water-cooled drive mechanism 122;

a crankshaft pulley 130 mounted to said engine crankshaft 128, said crankshaft pulley 130 having a first radius;

a belt 132 rotatably coupled to said crankshaft pulley 130 and said fan drive pulley 120;

an auxiliary pulley 102 coupled to said transfer drive mechanism 116 having a second radius, wherein said first radius and said second radius are sized to create a second overdrive mechanism to provide a desired rotational speed of said fan 114 relative to engine speed; and a second belt 126 rotatably coupled to said auxiliary pulley 102 and said second fan drive pulley 104;

wherein said second fan drive pulley 104 is coupled to said water-cooled drive mechanism 122 using a second transfer drive mechanism 124 and wherein said second fan pulley 104 is bearing mounted to a shroud 106 of said radiator 108 and coupled to said clutch 136 via a second transfer drive mechanism 124 and wherein said auxiliary pulley 102 is bearing mounted on said shroud 106.

27. The remote fan drive assembly of claim 26, wherein said water-cooled drive mechanism 122 comprises a water jacket-cooled viscous coupling coupled to a water pump, said water pump in fluid communication with said radiator 108 and said engine block.

28. The remote fan drive assembly of claim 26, wherein said water-cooled drive mechanism 122 comprises a fan drive pulley 120, a clutch 136, a working chamber 140 defined between said fan drive pulley 120 and said clutch 136, a quantity of viscous fluid contained within said working chamber 140, and an impeller 138 contained within an impeller chamber 146 coupled to said clutch 136, said impeller chamber 146 in fluid communication with said radiator 108 and said engine block.

29. The water-cooled remote fan drive assembly 100 of claim 26, wherein said first radius is approximately twice said second radius.

* * * * *